US005999786A

United States Patent [19]

Saito

[11] Patent Number: 5,999,786

[45] **Date of Patent: *Dec. 7, 1999**

[54] FIXING APPARATUS HAVING CLEANING MEMBER

[75] Inventor: Rie Saito, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/898,496

[22] Filed: Jul. 22, 1997

[30] Foreign Application Priority Data

Jul. 22, 1996 [JP] Japan ..... 8-192205

[51] Int. Cl.[6] ..... G03L 15/20

[52] U.S. Cl. ..... 399/327; 15/256.51

[58] Field of Search ..... 399/98, 99, 326, 399/327; 432/59, 60; 219/216; 15/209.1, 256.51, 256.52

[56] References Cited

U.S. PATENT DOCUMENTS

| | | | |
|---|---|---|---|
| 3,861,860 | 1/1975 | Thettu et al. | 432/59 |
| 3,980,424 | 9/1976 | Latone | 432/75 |
| 3,999,510 | 12/1976 | Thettu | 399/327 |
| 5,049,934 | 9/1991 | Saito . | |
| 5,608,508 | 3/1997 | Kumagai et al. . | |

FOREIGN PATENT DOCUMENTS

| | | |
|---|---|---|
| 50-57237 | 5/1975 | Japan . |
| 1-173084 | 7/1989 | Japan . |
| 1-173085 | 7/1989 | Japan . |
| 1-173086 | 7/1989 | Japan . |
| 1-173087 | 7/1989 | Japan . |
| 3-282579 | 12/1991 | Japan . |
| 5-6122 | 1/1993 | Japan . |
| 7-89257 | 9/1995 | Japan . |

*Primary Examiner*—Joan Pendegrass
*Attorney, Agent, or Firm*—Fitzpatrick, Cella, Harper & Scinto

[57] ABSTRACT

The present invention provides a fixing apparatus having a cleaning member for removing offset toner without damaging a roller surface, to thereby permit formation of a good image having no contamination and stripes for a long time. The cleaning member includes a base material, $Al_2O_3$ particles and polyester resin, and the $Al_2O_3$ particles are dispersed in the polyester resin and the base material is coated by the polyester resin dispersing therein the $Al_2O_3$ particles. The polyester resin dispersing therein the $Al_2O_3$ particles and coating the base material is contacted with the roller surface to thereby remove offset toner from the roller surface.

45 Claims, 4 Drawing Sheets

FIXING APPARATUS HAVING CLEANING MEMBER

BACKGROUND OF THE INVENTION

1. Field of the Invention

The present invention relates to a fixing apparatus used in an image forming apparatus such as an electrophotographic copying machine, and more particularly, it relates to a fixing apparatus having an improved cleaning member for cleaning a fixing rotary member of the fixing apparatus.

2. Related Background Art

In image forming apparatuses such as electrophotographic copying machines, as a last finishing step of an image forming process, a non-fixed image transferred to a recording material (for example, a paper sheet or an OHP sheet) is permanently fixed to the recording material. To this end, a fixing apparatus of a heat roll fixing type is generally used.

As shown in FIG. 7, a conventional fixing apparatus of a heat roll fixing type comprises a fixing device 10 of a heat roll fixing type and a cleaning device 20. The fixing device 10 includes a fixing roller 1 formed of a silicone rubber layer 3 having a predetermined thickness coated on an aluminium core cylinder 2, a pressure roller 4 constituted by a silicone rubber layer 6 having a predetermined thickness coated on an aluminium core cylinder 5 and a resin coating layer 6*a* disposed on the silicone rubber layers and heat sources 7 disposed within the fixing roller 1 and the pressure roller 4. A surface temperature of the fixing roller 1 is maintained at about 170° C. by heat from its heat source 7 and transmission of heat from the pressure roller 4.

According to the fixing apparatus having the above-mentioned construction, when a recording material 13 to which a non-fixed toner image 12 was transferred is sent to the fixing apparatus by a convey means (not shown), while the recording material is being passed through a nip between the fixing roller 1 and pressure roller 4 of the fixing device 10, the non-fixed toner image 12 is thermally fixed onto the recording material 13 by the fixing roller 1. In this case, a small amount of toner forming the non-fixed toner image on the recording material 13 is transferred (offset) to the surface of the fixing roller 1. When the toner is offset to the fixing roller 1, since there is a danger of smudging an electrophotographic image (i.e., worsening image quality) due to the offset toner, the surface of the fixing roller 1 is cleaned by the cleaning device 20.

Although various kinds of cleaning devices can be used as the cleaning device 20 shown in FIG. 7, a cleaning device in which a web 15 formed from fibers is contacted with the surface of the fixing roller 1 and the cleaning of the fixing roller 1 is effected by shifting the web 15 while contacting with the fixing roller is known (for example, refer to Japanese Patent Laid-Open Application No. 50-57237). Explaining in more detail, the cleaning device 20 comprises a web supply shaft 21, a web take-up shaft 22 and a hold-dowry roller 23. The web 15 is supplied from the supply shaft 21 and is wound around the take-up shaft 22; meanwhile, the web 15 is urged against the surface of the fixing roller 1 by the hold-down roller 23, thereby cleaning the fixing roller. An urging force of the hold-down roller 23 for urging the web 15 against the fixing roller 1 is adjusted by a pressurizing means such as a spring 24. The web 15 is shifted in a direction shown by the arrow C and is wound around the take-up shaft 22 by means of a driving device (not shown) for driving the take-up shaft 22. Incidentally, in FIG. 7, the reference numeral 16 denotes a mold releasing agent coating device for coating mold releasing agent such as silicone oil on the surface of the fixing roller 1 by means of a coating member 18

In the above web 15 formed from the fibers, since the toner scraped from the surface of the fixing roller 1 is absorbed between the fibers, the toner can be removed from the fixing roller efficiently, thereby providing high cleaning ability. However, since the fiber cloth of the web 15 is formed from Nomex (tradename: manufactured by Du Pont) there are the following disadvantages.

Nomex is obtained by weaving aramid fibers made of aromatic polyamide with polyester fibers and binding the aramid fibers and the polyester fibers to each other by heat. In the cleaning operation, due to the heat from the fixing roller 1 contacting with the web 15, the aramid fibers are softened to lose rigidity. Consequently, toner scraping ability (obtained by "fiber rigidity") of the aramid fibers is worsened, so that the toner offset on the fixing roller 1 passes through the softened aramid fibers in the web 15 not to clean the fixing roller 1 adequately.

Of course, even when the rigidity of the aramid fibers in the web 15 is lost to worsen the scraping ability, if an amount of the offset toner is small, the toner can be cleaned from the fixing roller 1 by the web 15. However, as the amount of offset toner is increased due to degradation of the fixing roller 1, the influence of the reduction of the scraping ability of the aramid fibers becomes noticeable, so that the toner cannot be removed from the fixing roller 1 adequately by the web 15, to thereby cause poor cleaning. Consequently, as the fixing roller 1 is further rotated, the offset toner still remaining on the fixing roller 1 is contacted with and transferred to the pressure roller 4 and/or the succeeding recording material, to thereby smudge the pressure roller and/or the recording material.

To avoid this, in the conventional techniques, PPS fibers which are not softened by heat were used as shown in Japanese Patent Laid-Open Application No. 3-183284, or, a web was metal-plated to increase rigidity of the web itself as shown in Japanese Patent Laid-Open Application No. 2-83691. These proposals increase the toner scraping ability. However, fundamentally, the fixing roller is constructed mainly in consideration of its mold releasing ability. Thus, since the surface of the fixing roller is constructed by relatively soft silicone rubber and the like, when the web having great rigidity is slidingly contacted with the fixing roller, the roller surface is damaged. That is to say, due to unevenness In fibers of the web itself and/or the plated metal foils on the web, a large number of scratches are formed on the surface of the fixing roller along its circumferential direction, which cause deterioration of image quality and shorten the service life of the fixing roller.

SUMMARY OF THE INVENTION

An object of the present invention is to provide a fixing apparatus in which toner can be removed from a roller by using a cleaning member which does not damage the roller surface (resulting in deterioration of image quality) for a long time while maintaining high cleaning ability, and an image having no stripes (due to scratches on the roller) can be obtained.

Another object of the present invention is to provide a fixing apparatus including a cleaning member having an abutment portion (abutting against a surface of a roller) coated by resin which can be softened by heat from the roller.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

Figure 1:
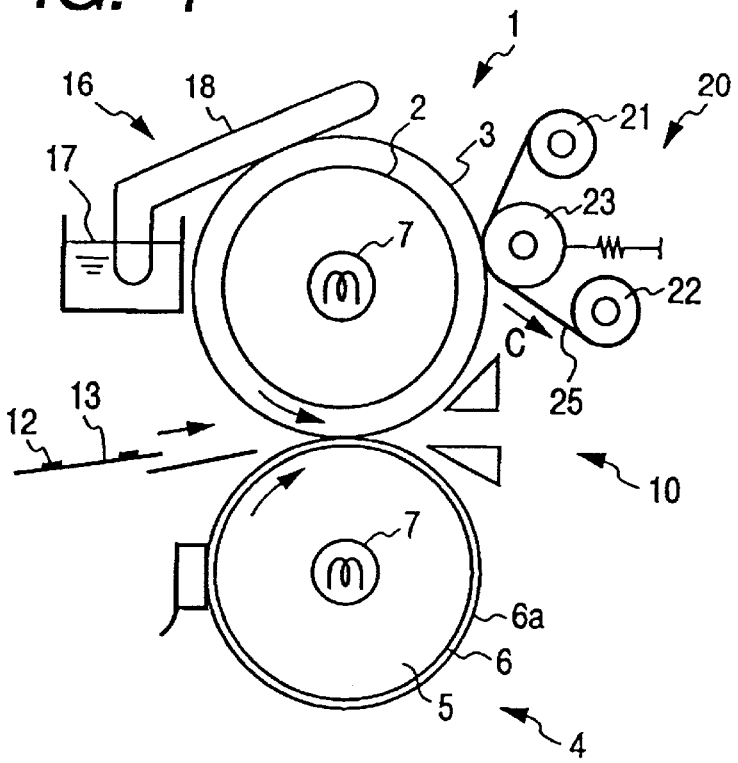
FIG. 1 is a schematic sectional view showing an embodiment of a fixing apparatus according to the present invention.
Figure 7:
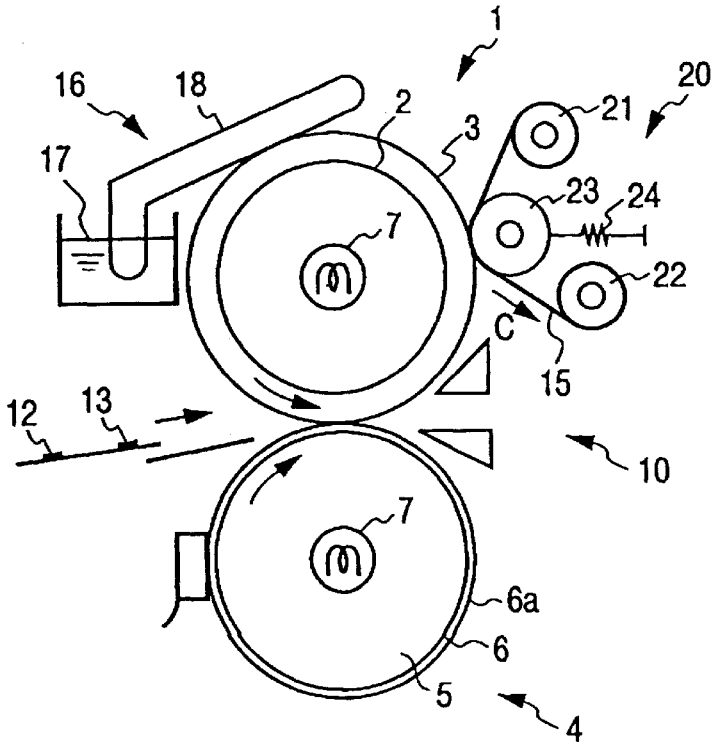
FIG. 7 is a schematic sectional view of a conventional fixing apparatus.

In a fixing apparatus according to an embodiment of the present invention shown in FIG. 1, a cleaning device 20 associated with a fixing device 10 includes a web 25 in which aramid fibers are coated by polyester resin dispersing therein $Al_2O_3$ powder. Since the other constructions of the cleaning device 20 of the fixing apparatus of this embodiment and function and the construction of the developing device 10 are substantially the same as those of the conventional fixing apparatus shown in FIG. 7, elements shown in FIG. 1 the same as those shown in FIG. 7 are designated by the same reference numerals and explanation thereof will be omitted.

A construction of the cleaning member in the illustrated embodiment is as follows.

A base material is formed from aramid fibers as is in the conventional cases. Aramid fibers having a size of about 1 to 10 deniers (when weight of a fiber having a length of 9000 m is 1 gram, a size of the fiber is 1 denier) are twined to form non-woven fabric. A size of single fiber is about 50 $\mu$m in average. The non-woven fabric has generally a height of unevenness of a front surface different from that of a rear surface. For example, in the conventional case, when the non-woven fabric alone is used as a cleaning member, the surface having higher unevenness of the fibers of the fabric is contacted with the fixing roller, because the higher unevenness surface can easily catch the melted toner. However, in the conventional non-woven fabric, since the unevenness is constituted by fibers having relatively great size of 1 to 10 denier, when the non-woven fabric is slidingly contacted with the roller, the surface of the roller is damaged with scratches. In this case, since the unevenness on the roller surface due to the scratches becomes great, quality of an image is worsened.

The present invention turns attention to such unevenness, polyester resin having a softening point of about 220° C. and dispersing therein non-metallic inorganic filler such as $Al_2O_3$ fine powder (alumina powder) (sufficiently smaller than the size of the fiber) is coated on the uneven surface of the non-woven fabric to which substances (such as resin contained in the toner) which are easily softened by heat are apt to adhere. By coating the polyester resin on the abutment surface having great unevenness, a cleaning member in which resin and inorganic filler are hard to be dropped due to anchor effect can be obtained.

Since the alumina particles are considerably smaller than the size of the fibers, when the alumina particles are coated on the non-woven fabric, fine unevenness having a height smaller than that of the unevenness of the fibers of the non-woven fabric is formed.

Figure 2A:
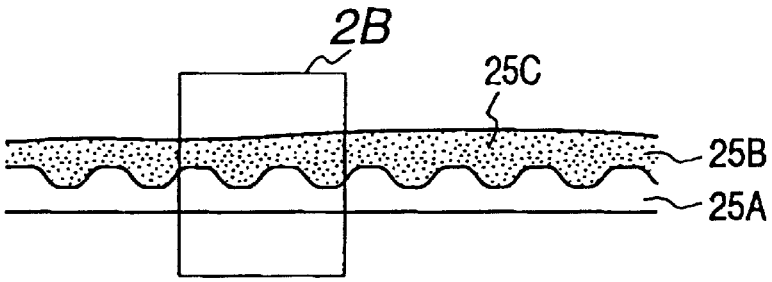
FIG. 2A is a sectional view of a portion of a cleaning member of the present invention.
Figure 2B:
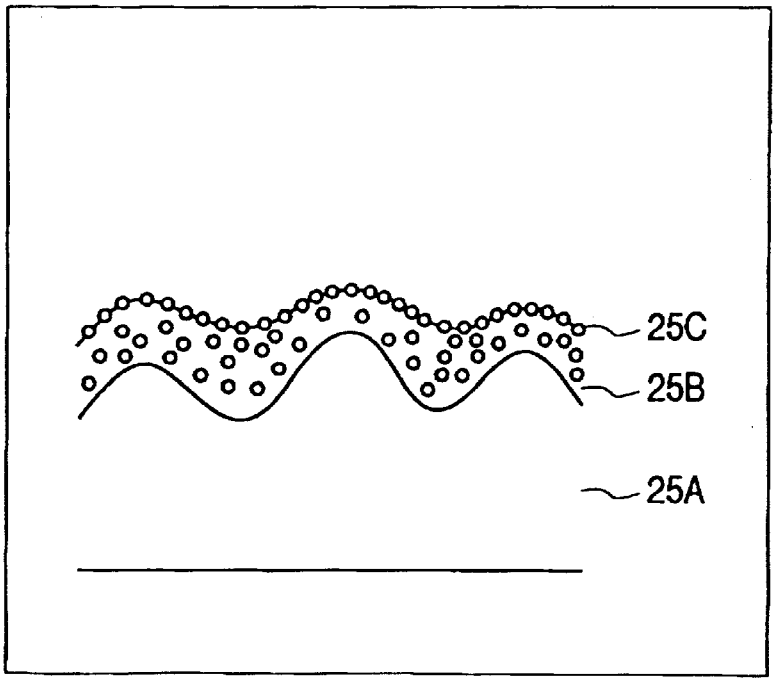
FIG. 2B is an enlarged view showing a portion 2B in FIG. 2A.

A model of a section of the cleaning member (web) used in the illustrated embodiment is shown in FIGS. 2A and 2B.

Polyester binder 25B dispersing therein non-metallic inorganic filler particles 25C is coated on a conventional non-woven fabric 25A of aramid fibers having great unevenness. In this way, unevenness of a coated surface becomes smaller than that of the surface of the base material 25A. That is to say, as shown in FIG. 2B, although the surface of the non-woven fabric is coated by the resin, fine unevenness is formed on the coated surfaces by the fine particles 25C while remaining the unevenness of the fibers of the fabric surface.

The non-metallic inorganic filler particles 25C is made of alumina ($Al_2O_3$), and an average particle diameter thereof is about 2 $\mu$m sufficiently smaller than the size of the fibers. Such particles are dispersed in the polyester binder by 5 weight percent (w %). However, even when the particles are dispersed by 0.1 w % to 20 w %, a good result can be obtained. Further, in order to obtain a desired result, similar to $Al_2O_3$ or $SrTi_2O_3$ particles having a softening point greater than that of the surface of the roller, hardness greater than that of the roller surface and a diameter sufficiently smaller than the size of the fibers may be used. When the particle diameter is 0.2 to 10 $\mu$m, a good result can be obtained. In the illustrated embodiment, polyester resin having a softening point of 210° C. and a melting point of 240° C. (greater than the temperature of the roller surface) is coated on the base material at a rate of 30 g/m$^2$. However, the softening point is not limited to the above value so long as, in use, the polyester resin is softened by the fixing temperature (near the temperature of the roller surface) and the included powder particles are not dropped from the cleaning member. Further, the coating amount may be appropriately adjusted on the basis of the hardness of the roller. For example, when the hardness of the roller surface is 20° to 40°, the polyester resin may be coated on the base material by 1 to 70 g/m$^2$ to obtain a good result.

The softening point of the polyester resin is obtained from a softening S curve (described later) as is in a measuring method for measuring a softening point of polyester resin in the toner.

In the present invention, since the non-woven fabric made of aramid fibers is coated by the polyester resin dispersing therein $Al_2O_3$, the surface of the roller (fixing rotary member) is prevented from being rubbed strongly. Since the polyester resin coating the non-woven fabric is softened by heat, the unevenness of the polyester resin is deformed by the unevenness of the roller surface as the roller is rotated. That is to say, when the softened resin against which the protruded portion of unevenness of the roller surface is pushed toward the shifting direction of the protruded portion, the softened resin is deformed in dependence upon the shape of the unevenness of the roller surface. Thus, the $Al_2O_3$ particles do not act on the roller surface strongly, so that, since the $Al_2O_3$ particles rub the roller surface weakly, any scratches are not formed on the roller surface.

Further, since the $Al_2O_3$ particles exposed to the surface of the polyester binder resin coating the non-woven fabric are very fine and harder than the silicone rubber forming the roller surface, when these particles are slidingly contacted with the roller surface, the roller surface is worn away little by little and, at the same time, the offset toner is scraped from the roller surface.

Since the resin dispersing therein the $Al_2O_3$ particles and coating the non-woven fabric of aramid fibers is polyester resin, such resin has good affinity to the polyester resin of the binder in the toner. That is to say, since the principal chains of resin of toner binder and principal chains of resin coating the non-woven fabric have the same chemical linkage, affinity becomes great, and, thus, when the resin(s) is deformed by pressure and heat, these resins can easily be adhered to each other.

In the conventional cleaning member, the offset toner cannot be removed completely and, thus, the offset toner is gradually accumulated on the roller surface, so that the image is smudged by the offset toner. To the contrary, in the present invention, since the polyester resin exists between the non-woven fabric and the roller, the wearing of the roller surface by the $Al_2O_3$ particles dispersed in the resin can be minimized, and, due to the strong affinity between the polyester resins, the offset toner can easily be collected. Since the $Al_2O_3$ particles are very fine and are dispersed uniformly in the polyester resin, the roller surface can be worn away little by little to remove the offset toner completely. Further, in the web having high rigidity fibers or in the web which is metal-plated, since the unevenness of the surface of the web is great, deeper scratches are formed on the roller surface. To the contrary, in the present invention, since the diameters of the $Al_2O_3$ particles are considerably smaller than the height of unevenness of the surface of the non-woven fabric, the roller surface can be worn away little by little, so that any scratches are formed on the roller surface, to thereby prevent deterioration of image quality.

Endurance test results effected by using the conventional web and the web according to the present invention are shown in the following Table 1.

TABLE 1

| | Number of Offset | Stripe in Image due to Roller Scratches |
|---|---|---|
| Web of aramid fibers alone | 20000 sheets NG | 100000 sheets NG |
| Metal-plated web of aramid fibers | 100000 sheets NG | 20000 sheets NG |
| Web of PPS fibers | 100000 sheets NG | 80000 sheets NG |
| Web of this invention | 150000 sheets OK | 150000 sheets OK |

As apparent from the above Table 1, when the cleaning member according to the present invention is used, the service life of the fixing roller can be extended in comparison with the conventional cleaning members.

Figure 3:
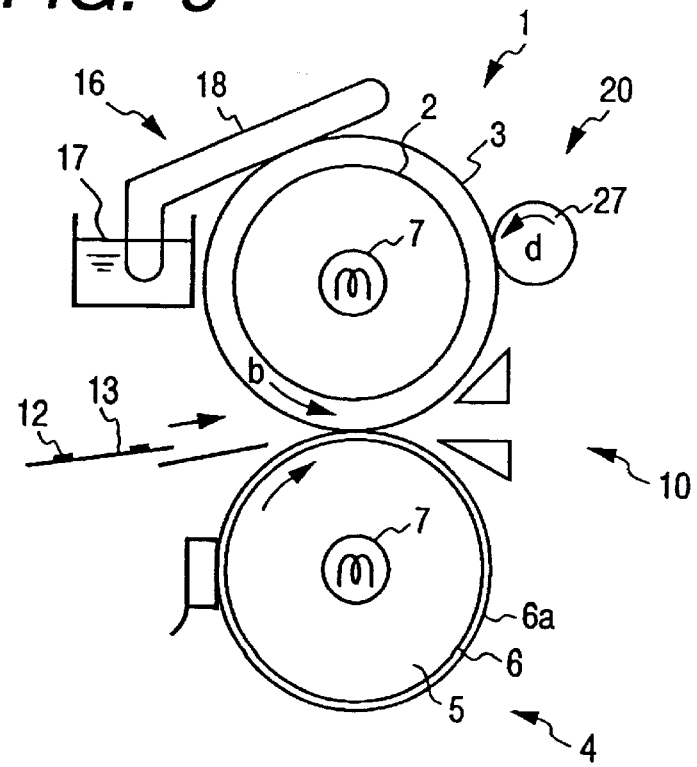
FIG. 3 is a schematic sectional view showing another embodiment of a fixing apparatus according to the present invention.
Figure 4:
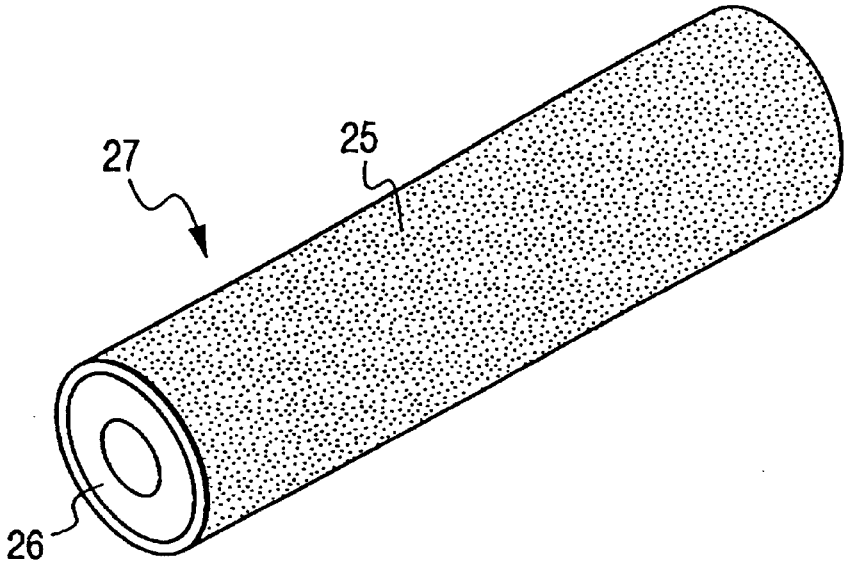
FIG. 4 is a perspective view of a cleaning member used in a cleaning device of the fixing apparatus of FIG. 3.

In another embodiment, the web 25 obtained by coating the non-woven fabric of aramid fibers with the polyester resin dispersing therein $Al_2O_3$ powder in the aforementioned embodiment is wound around a pipe 26 to form a cleaning member 27, as shown in FIG. 4. This cleaning member 27 is used in the cleaning device 20. As shown in FIG. 3, the cleaning member 27 is urged against the fixing roller 1 and is rotated by a driving device (not shown) in a direction d (opposite to a rotational direction b of the fixing roller 1) at a rotational peripheral speed different from that of the fixing roller 1.

Also in this embodiment, since the cleaning member 27 utilizes the web 25 constituted by the non-woven fabric of aramid fibers coated by the polyester resin dispersing therein non-metallic inorganic powder having the particle diameter smaller than the size of the fibers, the cleaning ability for the fixing roller 1 is excellent, and, thus, even when 150000 sheets are fixed in the same fixing test as in the first embodiment, the offset toner is not passed through the web 25 and the roller is not damaged, to thereby clean the fixing roller 1 effectively.

Figure 5:
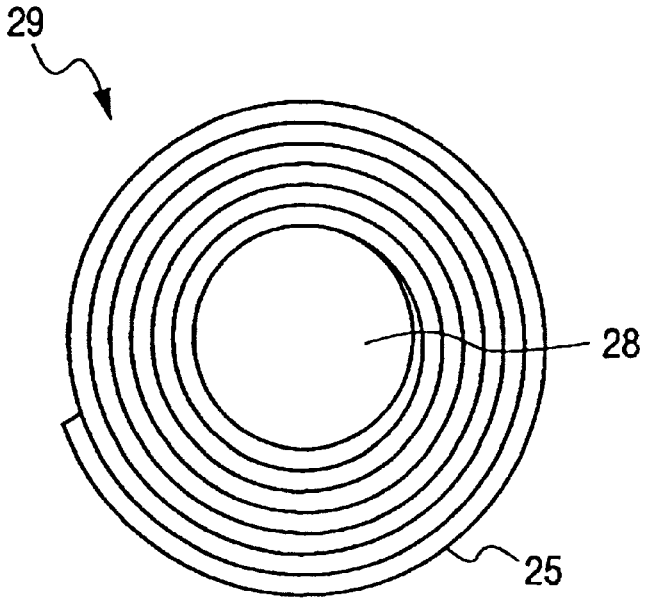
FIG. 5 is a sectional view of a cleaning member used in a cleaning device of a fixing apparatus according to a further embodiment of the present invention.

FIG. 5 shows another cleaning member used in the cleaning device 20 in place of the cleaning member 27. As shown in FIG. 5, this cleaning member 29 is constituted by winding the web 25 around a pipe 28 to form a plurality of web layers. The cleaning member 29 is urged against the fixing roller 1. However, unlike to the embodiment shown in FIG. 3, the cleaning member 29 is rotatingly driven by the rotation of the fixing roller 1 in the same direction as the fixing roller 1 at the same peripheral as the fixing roller.

Also in this embodiment, since the cleaning member 29 utilizes the web 25 constituted by the non-woven fabric of aramid fibers coated by the polyester resin dispersing therein non-metallic inorganic powder having the particle diameter smaller than the size of the fibers, the cleaning ability for the fixing roller 1 is excellent, and, thus, even when 150000 sheets are fixed in the similar fixing, the offset toner is not passed through the web 25 and the roller is not damaged, to thereby clean the fixing roller 1 effectively.

Further, in this embodiment, since the cleaning member 29 is constituted by winding the web 25 to form the plurality of web layers, when the surface of the web 25 is smudged by the removed toner, by cutting and removing an outermost web layer 25, a new web surface can be used. Thus, in the embodiment shown in FIG. 3, when the surface of the web 25 is smudged by the removed toner, the entire cleaning member 27 including the web 25 and the pipe 26 must be discarded. To the contrary, in the cleaning member 29 according to this embodiment, since when the surface of the web 25 is smudged by the removed toner a new web surface can be used, the service life of the entire cleaning member can be extended. In this case, when transverse perforation lines are formed on the web 25 at a predetermined interval along a longitudinal direction of the web, the waste web portion (layer) can easily be removed to expose a new web surface.

The cleaning device 20 of the aforementioned fixing apparatus according to the present invention is particularly effective to the cleaning of a fixing roller of a full-color image forming apparatus. Now, this will be described.

In a color image forming apparatus in which a yellow color toner image, a magenta color toner image, a cyan color toner image and a black color toner image are successively transferred onto a recording material 13 in a superimposed fashion, in order to reproduce a color near the color of an original image, since the laminated toner images are fused and mixed, sharp melt toner having a low softening point (i.e., low melting point) must be used. In order to improve the mold releasing ability, wax is mixed with the toner. Since the wax has a high melting point, a large amount of wax cannot be mixed with the toner to keep the toner in a low melting point.

Thus, the sharp melt toner is apt to be offset (transferred) to the fixing roller 1. Further, since a thickness of toner to be great due to the presence of the laminated toner images, the toner offset easily occurs. In addition, since different color toners have different components, in a fixing apparatus in which constant temperature control is effected, the toner offset is further increased.

Accordingly, the material constituting the surface of the fixing roller 1 of the fixing apparatus used in the full-color image forming apparatus is particularly limited. In this regard, it is hard to use fluororesin group such as Teflon (which has been used as material of the fixing roller in a fixing apparatus of a mono-color image forming apparatus in consideration of mold releasing ability) as material of the surface of the fixing roller. Thus, similar to the fixing roller 1 of the fixing device associated with the cleaning device 20 of the conventional fixing apparatus shown in FIG. 7, a silicone rubber layer 3 or a silicone resin layer is coated on the surface of the fixing roller 1. If fluororesin is used on a fixing roller, the mold releasing agent such as silicone oil is coated on the fixing roller 1 to prevent toner offset. Hence, the material of the surface of the fixing roller 1 is preferably silicone group familiar to silicone oil, and is more preferably silicone group including silicone oil. As silicone rubber, RTV silicone rubber (room temperature vulcanized silicone rubber) is particularly preferred.

In a combination of sharp melt toner and the fixing roller 1 coated by the silicone rubber layer 3, since an adhering force between the sharp melt toner and the silicone rubber is great, the offset toner cannot be removed adequately, and, thus, the offset toner is accumulated on the roller surface, so that the. obtained image becomes dark. Accordingly, it is required that the offset toner is removed from the fixing roller 1 adequately. According to the cleaning device 20 of the present invention, since the cleaning ability is excellent, the above requirement can be satisfied.

The toners used in the full-color image formation are manufactured, for example, by fusing, kneading, grinding and classifying polyester resin, colorant (dye or sublimable dye) and charge control agent. If necessary, various additives may be added to the toners.

The average particle diameter of the toner is normally 3 to 30 $\mu$m and is smaller than the size of the aramid fibers of the non-woven fabric (base material) of the cleaning member according to the illustrated embodiment and is greater than the average particle diameter of the $Al_2O_3$ particles dispersed in the resin coating the base material. Regarding the color toners, in consideration of anti-offset ability, fixing ability and sharp melt ability, it is particularly preferable that polyester resin is used as bonding resin. Sharp melt polyester resin is high-molecular compound having ester linkage in principal chain of molecule synthesized from diol compound and di-carboxylic acid.

The softening point of the sharp melt polyester resin is 60 to 150° C. lower than the temperature of the roller surface and is preferably 80 to 120° C. The softening point is a temperature To measured by a method described herein below. However, the measuring method can be altered on the basis of the method used in the present invention. The measurement was effected as follows. A flow tester CFT-500A (manufactured by Shimazu Seisakusho, Japan) was used, where a diameter of a die (nozzle) was selected to 0.2 mm and a thickness was selected to 1.0 mm and an extrusion load of 20 Kg was applied. After pre-heating was effected at initial set temperature of 70° C. for 300 seconds, isothermal temperature increase was effected at a rate of 6° C./min. Under this condition, a curve representing a relation between a plunger descent amount of toner and a temperature (referred to as "softening S curve" hereinafter) was sought. Refined fine toner powder of 1 to 3 grams was used as specimen, and a cross-sectional area of the plunger was selected to 1.0 $cm^2$.

Figure 6:
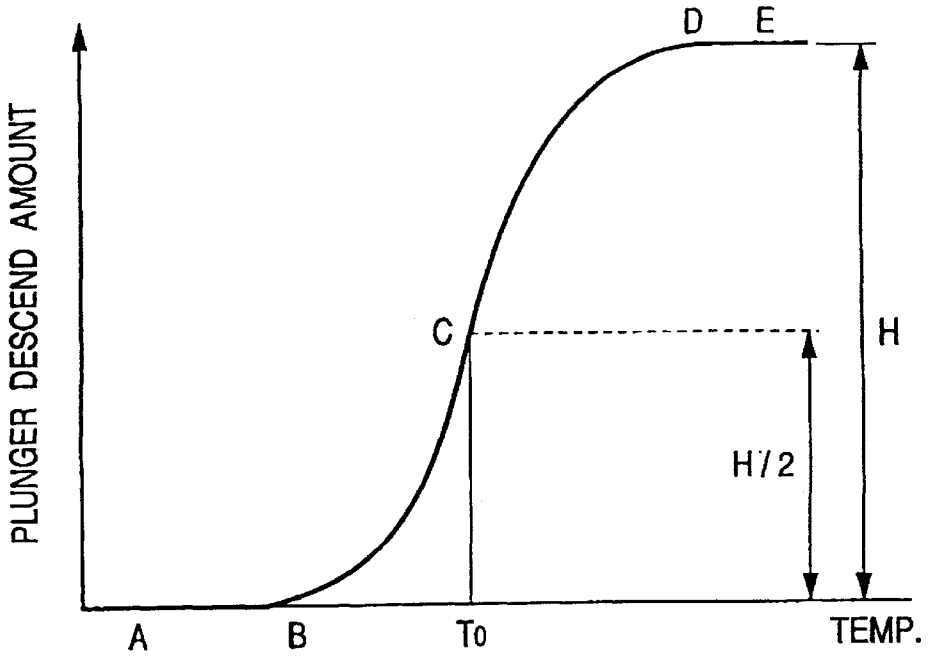
FIG. 6 is a graph showing a relation between a plunger descent amount and a temperature in measurement of a toner softening point.

The softening S curves generally becomes as shown in FIG. 6. As the isothermal temperature increase goes on, the toner is gradually heated and starts to flow (plunger descent amount A→B). When the temperature is further increased, fused toner flow greatly (B→C→D), and the plunger descent is stopped (D→E). A height H of the S curve shows a total flow amount of toner, and a temperature $T_0$ corresponding to H/2 (point C) represents a softening point of toner.

The sharp melt resin is resin satisfying conditions $T_1$=100 to 150° C., $|\Delta T|=|T_1-T_2|$=5 to 30° C. when the temperature of resin in the fused viscosity of $10^5$ cp is $T_1$ and the temperature of resin in the fused viscosity of $5\times10^4$ cp (Incidentally, 1 cp (centipoise)=$1\times10^{-3}$ dyn·sec/$m^2$). The sharp melt resin having such temperature/fused viscosity feature has a characteristic in which when it is heated viscosity thereof is decreased sharply. Such sharp reduction in viscosity moderately mixes the uppermost toner layer and the lowermost toner layer with each other and abruptly increases the transparency of the toner layer itself, thereby achieving effective subtractive color mixture.

If the resin having the temperature $T_1$ lower than 100° C. is used in the toner, since the blocking easily occurs, storing stability of toner will be worsened, and, if the resin having the temperature $T_1$ higher than 150° C. is used in the toner, poor mixing will occur and fixing ability will become unstable. As an option, material used as toner bonding resin may be appropriately added to the toner. The colorant used in the toner may be known dye, pigment or combination thereof.

A cleaning device using the web 25 having fibrous member coated by polyester resin dispersing therein inorganic filler particles is particularly effective to the fixing apparatus of the above-mentioned full-color image forming apparatus. The reason is that, when the color toner which can easily be melted is offset onto the fixing roller, in the Nomex web losing rigidity by heat, since the softened resin exists on the surface of the web, resiliency of the web is weakened and the toner easily passes through unevenness on the web surface between fibers, and, in the PPS fibers or metal-plated fibers, the roller surface is damaged. To the contrary, in the fibers coated by polyester resin dispersing therein inorganic filler particles having a diameter smaller than the size of the fibers, even when the fibers lose their rigidity by heat, since the offset toner can be removed by deformation of the coating resin, adhesion between the resin and toner, and small unevenness formed by the filler and the resin, the melted toner on the fixing roller 1 can be scraped and removed without damaging the fixing roller (i.e., high cleaning ability can be achieved).

When the toner is adhered to the silicone rubber layer 3 of the fixing roller 1, an adhering force in this case becomes greater than the adhering force in a case where the toner is adhered to a Teflon layer of the fixing roller. However, in the present invention, since the cleaning ability of the cleaning device 20 is great, the cleaning device can be used in both cases.

In the above embodiments, while an example that the non-woven fabric is used as the base material was explained, the base material is not limited to the non-woven fabric, but may be an elastic body such as sponge. The reason is that, although the resin coating the base material is softened by the temperature of the roller surface and is deformed in dependence upon the unevenness of the roller surface, when the base material is formed from the elastic body, the base material can more easily follow the unevenness of the roller surface.

In order to facilitate the holding of the scraped toner on the surface of the polyester resin, the surface of the polyester resin preferably has unevenness. In order to provide the unevenness on the surface of the coating polyester resin, as is in the aforementioned embodiment, the resin may be coated on the surface of the base material having the greater unevenness than the particle diameter of the toner.

In the illustrated embodiments, while an example that the polyester resin is used was explained, for example, when styrene-acrylic resin is included in the toner, the base material may be coated by the styrene-acrylic resin, so that principal chain of the resin in the toner may have the same chemical linkage as the principal chain of the resin coating the base material.

As mentioned above, in the fixing apparatus according to the present invention, when rollers including a fixing roller used in the fixing of a non-fixed image born on a recording material is cleaned by a cleaning device, by using the fibrous member coated by polyester resin dispersing therein non-metallic inorganic filler such as $Al_2O_3$ as a cleaning member, the offset toner on the fixing roller can be removed and cleaned effectively without damaging the fixing roller, so that a good quality image having no contamination and stripes can be obtained stably for a long time.

What is claimed is:

1. A fixing apparatus comprising:

a fixing rotary member for fixing a toner image to a recording material by contacting with a non-fixed toner image on the recording material;

a heating means for heating said fixing rotary member; and a cleaning member contacted with said fixing rotary member for cleaning a surface of said fixing rotary member; and wherein said cleaning member has an abutment portion for abutting against said fixing rotary member, said abutment portion being coated by a resin including exposed fine particles harder than a surface of said fixing rotary member, and said resin being softened by heat from said fixing rotary member.

2. A fixing apparatus according to claim 1, wherein said cleaning member has a base material on which said resin having said exposed fine particles is coated, and said base material is made of an elastic material.

3. A fixing apparatus according to claim 2, wherein said elastic material is a fibrous member.

4. A fixing apparatus according to claim 3, wherein said fibrous member has aramid fibers.

5. A fixing apparatus according to claim 2, wherein said elastic material is a sponge.

6. A fixing apparatus according to claim 1, wherein said cleaning member has a base material on which said resin having said exposed fine particles is coated, and said base material has convex portions and concave portions.

7. A fixing apparatus according to claim 6, wherein said base material is a fibrous member.

8. A fixing apparatus according to claim 7, wherein said fibrous member is non-woven fabric.

9. A fixing apparatus according to claim 7, wherein an average particle diameter of said fine particles is smaller than a size of a fiber of said fibrous member.

10. A fixing apparatus according to claim 6, wherein an average particle diameter of said fine particles is smaller than a height of the convex and concave portions.

11. A fixing apparatus according to claim 1, wherein an average particle diameter of said fine particles is greater than 0.2 $\mu$m and smaller than 10 $\mu$m.

12. A fixing apparatus according to claim 1, wherein said fine particles include $Al_2O_3$.

13. A fixing apparatus according to claim 1, wherein said fine particles are dispersed in said resin.

14. A fixing apparatus according to claim 13, wherein said fine particles are included in said resin at a rate of 0.1 to 20 weight percent.

15. A fixing apparatus according to claim 1, wherein principal chain of said resin has the same chemical linkage as principal chain of resin included in the toner.

16. A fixing apparatus according to claim 15, wherein the chemical linkage is ester linkage.

17. A fixing apparatus according to claim 1, wherein said resin includes polyester resin.

18. A fixing apparatus according to claim 1, wherein said cleaning member is slidingly contacted with the surface of said fixing rotary member.

19. A fixing apparatus comprising:

a fixing rotary member for fixing a toner image comprising a first resin to a recording material by contacting with a non-fixed toner image;

a heating means for heating said fixing rotary member; and a cleaning member contacted with said fixing rotary member for cleaning a surface of said fixing rotary member;

wherein said cleaning member has an abutment portion abutted against said fixing rotary member and is slidingly contacted with the surface of said fixing rotary member, said abutment portion being coated by a second resin, and a principal chain of said second resin having the same chemical linkage as principal chain of said first resin.

20. A fixing apparatus according to claim 19, wherein said first resin and said second resin are softened by heat from said fixing rotary member.

21. A fixing apparatus according to claim 19, wherein the chemical linkage of the principal chains of said first and second resins is ester linkage.

22. A fixing apparatus according to claim 21, wherein said first and second resins include polyester resin.

23. A fixing apparatus according to claim 19, wherein the chemical linkage of the principal chains of said first and second resins is styrene-acrylic linkage.

24. A fixing apparatus according to claim 23, wherein said first and second resins include styrene-acrylic resin.

25. A fixing apparatus according to claim 19, wherein fine particles harder than the surface of said fixing rotary member are exposed at said abutment portion.

26. A fixing apparatus according to claim 25, wherein an average particle diameter of said fine particles is greater than 0.2 $\mu$m and smaller than 10 $\mu$m.

27. A fixing apparatus according to claim 25, wherein said fine particles include $Al_2O_3$.

28. A fixing apparatus according to claim 25, wherein said fine particles are dispersed in said resin.

29. A fixing apparatus according to claim 28, wherein said fine particles are included in said resin at a rate of 0.1 to 20 weight percent.

30. A fixing apparatus according to claim 19, wherein a softening point of the toner is smaller than a temperature of the heated surface of said fixing rotary member.

31. A fixing apparatus according to claim 19, wherein said second resin is softened by heat from said fixing rotary member.

32. A fixing apparatus according to claim 19, wherein a sliding direction of said cleaning member and a moving direction of a surface of said fixing rotary member at said abutment portion are opposite to each other.

33. A fixing apparatus according to claim 19, wherein a sliding speed of a surface of said cleaning member and a sliding speed of a surface of said fixing rotary member are different from each other.

34. A fixing apparatus comprising:

a fixing rotary member for fixing a toner image comprising a first resin to a recording material by contacting with a non-fixed toner image;

a heating means for heating said fixing rotary member; and a cleaning member contacted with said fixing rotary member for cleaning a surface of said fixing rotary member;

wherein said cleaning member has an abutment portion abutted against said fixing rotary member, said abutment portion being coated by a second resin, and a principal chain of said second resin having the same chemical linkage as principal chain of said first resin, and wherein said cleaning member has a base material on which said second resin is coated, and a coating amount is greater than 1 $g/m^2$ and smaller 70 $g/m^2$.

35. A fixing apparatus comprising:

a fixing rotary member for fixing a toner image comprising a first resin to a recording material by contacting with a non-fixed toner image;

a heating means for heating said fixing rotary member; and a cleaning member contacted with said fixing rotary member for cleaning a surface of said fixing rotary member;

wherein said cleaning member has an abutment portion abutted against said fixing rotary member, said abutment portion being coated by a second resin, and a principal chain of said second resin having the same chemical linkage as principal chain of said first resin, wherein a melting point of said second resin is greater than a temperature of the heated surface of said fixing rotary member.

36. A fixing apparatus comprising:

a fixing rotary member for fixing a toner image to a recording material by contacting with a non-fixed toner image on the recording material; and a cleaning member contacted with said fixing rotary member for cleaning a surface of said fixing rotary member;

wherein said cleaning member has a base material, a resin coating said base material and non-metallic particles, said cleaning member being slidingly contacted with the surface of said fixing rotary member, and said base material abutted against said fixing rotary member and including said non-metallic particles.

37. A fixing apparatus according to claim 36, wherein said non-metallic particles have hardness greater than that of the surface of said fixing rotary member.

38. A fixing apparatus according to claim 36, wherein said non-metallic particles are exposed to the surface of said resin.

39. A fixing apparatus according to claim 36, wherein said non-metallic particles are dispersed in said resin.

40. A fixing apparatus according to claim 36, wherein said non-metallic particles include $Al_2O_3$.

41. A fixing apparatus according to claim 36, wherein said resin includes polyester resin.

42. A fixing apparatus according to claim 36, wherein said base material is a fibrous member having aramid fibers.

43. A fixing apparatus according to claim 36, wherein an average particle diameter of said non-metallic particles is greater than 0.2 $\mu$m and smaller than 10 $\mu$m.

44. A fixing apparatus according to claim 36, wherein a sliding direction of said cleaning member and a moving direction of a surface of said fixing rotary member at said abutment portion are opposite to each other.

45. A fixing apparatus according to claim 36, wherein a sliding speed of a surface of said cleaning member and a sliding speed of a surface of said fixing rotary member are different from each other.

* * * * *

UNITED STATES PATENT AND TRADEMARK OFFICE

CERTIFICATE OF CORRECTION

PATENT NO. : 5,999,786

DATED : December 7, 1999

INVENTOR(S): RIE SAITO

It is certified that error appears in the above-identified patent and that said Letters Patent is hereby corrected as shown below:

COLUMN 1,
Line 57, "hold-dowry" should read --hold-down--.

COLUMN 2,
Line 46, "In" should read --in--.

COLUMN 4,
Line 23, "is" should read --are--.

COLUMN 6,
Line 16, "to" should be deleted.

COLUMN 7,
Line 26, "the." should read --the--; and
Line 51, "To" should read --$T_o$--.

UNITED STATES PATENT AND TRADEMARK OFFICE

CERTIFICATE OF CORRECTION

PATENT NO. : 5,999,786

DATED : December 7, 1999

INVENTOR(S): RIE SAITO

It is certified that error appears in the above-identified patent and that said Letters Patent is hereby corrected as shown below:

COLUMN 8,
Line 1, "becomes" should read --become--.

Signed and Sealed this

Twenty-eighth Day of November, 2000

*Attest:*

*Attesting Officer*

Q. TODD DICKINSON

*Director of Patents and Trademarks*